United States Patent [19]

Olsson

[11] 4,381,638

[45] May 3, 1983

[54] APPARATUS WITH A BOBBIN SUPPORT MEMBER

[75] Inventor: Per O. Olsson, Genevad, Sweden

[73] Assignee: Rieter Machine Works Limited, Winterthur, Switzerland

[21] Appl. No.: 185,015

[22] Filed: Sep. 8, 1980

[30] Foreign Application Priority Data

Sep. 28, 1979 [CH] Switzerland ..... 8786/79

[51] Int. Cl.[3] ..... D01H 1/12

[52] U.S. Cl. ..... 57/90; 57/91; 57/408; 57/409; 242/129.7; 242/130.2

[58] Field of Search ..... 57/58.89, 58.95, 90, 57/91, 317, 209, 408, 409; 242/129.5–130.2, 131, 132, 134–139

[56] References Cited

U.S. PATENT DOCUMENTS 928,831 7/1909 Wood ..... 57/209
3,197,156 7/1965 Warnock ..... 242/130.2
3,394,538 7/1968 Neff ..... 57/91 X
3,400,899 9/1968 Tytgath ..... 242/129.7 X
3,816,991 6/1974 Takeuchi et al. ..... 57/90

*Primary Examiner*—John Petrakes
*Attorney, Agent, or Firm*—Werner W. Kleeman

[57] ABSTRACT

The present invention concerns the production of fancy yarns, in which during open-end spinning a roving is supplied program-controlled to the spinning unit for the yarn to be produced. According to the invention at least one roving bobbin is supported by a support member, which is detachably arranged on a can used as a receptable for the fibre material to be processed. The bobbin creel used up to the present for the bobbins impairs the accessability of the winding locations for the fancy yarn produced. This creel, according to the invention, no longer is required. Thus, the cumbersome mounting and dismantling of the creel in changing over from normal yarn to fancy yarn and vice-versa is dispensed with. According to the invention the alterations required for such changes of the yarn production mode are extremely simple.

6 Claims, 2 Drawing Figures

APPARATUS WITH A BOBBIN SUPPORT MEMBER

BACKGROUND OF THE INVENTION

The present invention relates to a new and improved construction of an apparatus with a bobbin support member for an open-end spinning machine for producing fancy yarn, which contains fibre sliver deposited in a can and roving wound onto bobbins. There is provided means for supplying the fibre sliver and the roving to a spinning unit.

In producing fancy yarns in the afore-mentioned manner in addition to the cans normally used in spinning, in which the fibre sliver to be processed is deposited, there also must be arranged the bobbins containing the roving generating the fancy effect. These bobbins were heretofore placed on creels arranged immediately in front of the locations where the produced fancy yarn is wound-up. In such arrangements there is impaired accessability to these winding locations and the overall observability in the spinning room. Since such creels used for the roving bobbins are not required for spinning normal yarns, the creels must be dismantled, or remounted, respectively, for spinning fancy yarns, which procedures require considerable additional work.

SUMMARY OF THE INVENTION

Therefore, with the foregoing in mind it is a primary object of the present invention to overcome the aforementioned disadvantages of the prior art systems.

Another and more specific object of the present invention aims at providing a new and improved construction of an apparatus containing a bobbin support member wherein it is possible to produce both normal yarn and fancy yarn, without the need for a bobbin creel, thereby avoiding impairment of the accessability of the winding locations for the fancy yarn produced by bobbin creels or the like which no longer are needed.

Still a further significant object of the present invention aims at a new and improved construction of apparatus containing a bobbin support member which enables the selective production of normal yarns or fancy yarns in a most simple and reliable manner.

Now in order to implement these and still further objects of the invention, which will become more readily apparent as the description proceeds, the present invention is manifested by features that a bobbin support member is detachably arranged on the fibre sliver can, and this bobbin support member is provided with at least one support element which is used for supporting a roving bobbin.

According to the present invention it is therefore possible to dispense with the need for any special bobbin creel, and therefore, there is not required the mounting and dismantling of such bobbin creel when changing over from processing normal yarn to fancy yarn and vice-versa. With the inventive arrangement it is only necessary to simply hook the bobbin support members onto the fibre sliver cans and, whenever they are not required, these bobbin support members are lifted off therefrom and set aside. These operations are extremely simple to carry out and can be performed quickly. Furthermore, the bobbin support members can be easily and simply manufactured.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
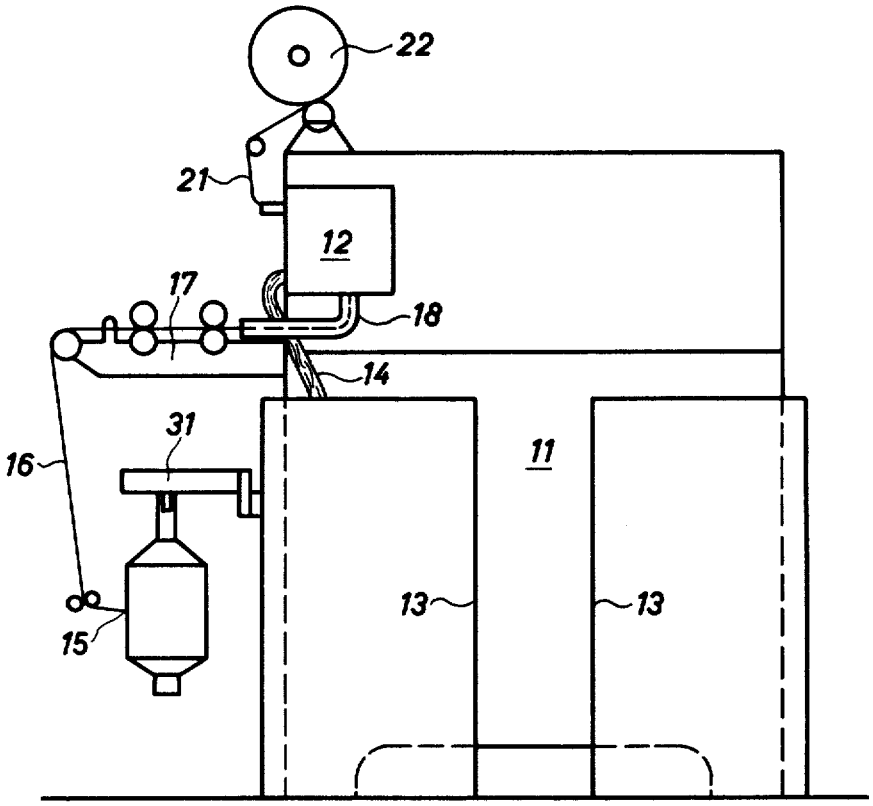
FIG. 1 is a schematic view of an exemplary embodiment of inventive apparatus used in connection with a spinning machine.
Figure 2:
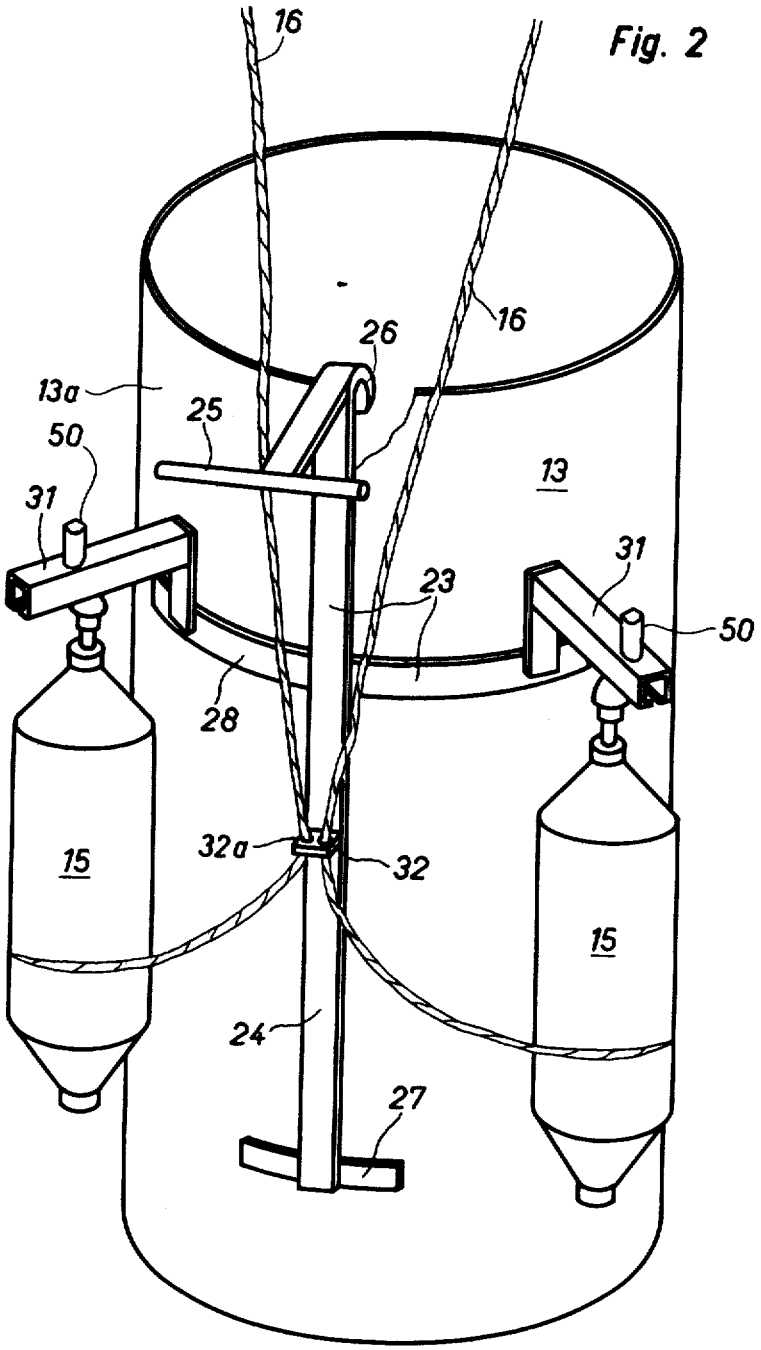
FIG. 2 is a perspective view of a bobbin support member shown arranged on a fibre sliver can.

At this point it is mentioned that in both FIGS. 1 and 2 the same parts or components have been conveniently designated with the same reference characters.

Drawing now attention specifically to the arrangement of FIG. 1, there will be recognized a conventional spinning machine 11 containing a suitable spinning unit 12. Cans 13 are used as receptacles for the fibre sliver 14 which is to be processed. In the showing of FIG. 1 a portion of a fibre sliver 14 is illustrated as the same is being supplied to the spinning unit 12. A roving 16 is supplied from a roving bobbin 15 to a drafting arrangement 17, where the roving 16 is drafted in bunches according to a programme. The drafted roving 16 is then further supplied to a supply or feed duct or conduit 18. Under the influence of a suction action the fibre bunches are sucked through this supply duct 18 into the spinning unit 12. The fancy yarn 21 which has been produced is then wound onto a bobbin package 22.

As best seen by referring to FIG. 2, a bobbin support member 23 is shown mounted on one of the fibre sliver cans 13. In the illustrated exemplary embodiment, this bobbin support member 23 comprises a vertically arranged rod member or rod 24 provided with a handle 25, a hook 26 or other suitable can engaging element and a contacting or bracing member 27. A horizontally arranged, curved rod 28 is rigidly connected with the vertical rod 24 and extends laterally to both sides thereof. On each half of the rod 28 there is mounted a support element 31, and on each of these support elements 31 there is supported a roving bobbin 15. The roving 16 unwound from the related bobbin 15 is guided through an associated eyelet **32*a* of a thread guide 32 mounted upon the rod member 24. The bobbin support member 23 is placed on the fibre sliver can 13 or the like by hooking the hook or engaging element 26 of the support member 23 onto the top edge or rim of the can 13. The bobbins 15 are rotatably suspended by the support elements 31. As the roving 16 is withdrawn from its related bobbin 15 these bobbins 15** rotate about their own lengthwise axis.

According to another embodiment of the invention which has merely been schematically illustrated in broken lines in FIG. 2, there can be provided upwardly or vertically extending pins 50 upon support elements corresponding to the support elements 31. On each such pin 50 there is then rigidly donned a roving bobbin 15. Since with this arrangement the roving is removed overhead, there is not required any thread guide 32.

If as shown in FIG. 2, the fibre sliver can 13 is provided with a circular-cylindrical side wall **13*a*, then there is advantageously employed a curved rod or bracket 28, whose radius of curvature corresponds to the radius of the cylindrical side wall 13*a* of the can 13**.

In this way there can be achieved a good and clean fitting contact of the rod 28 on the can 13. Also, the contacting or bracing member 27 advantageously may be provided with a similar curvature.

While there are shown and described preferred embodiments of the invention, it is to be distinctly understood that the invention is not limited thereto, but may be otherwise variously embodied and practiced within the scope of the following claims. Accordingly,

What I claim is:

1. An apparatus for use with an open-end spinning machine for producing a fancy yarn, comprising:

a fibre sliver can containing fibre sliver deposited therein;

a bobbin support member detachably mountable upon said fibre sliver can;

said bobbin support member being provided with means for detachably mounting said bobbin support member on said can; and at least one support element for supporting a roving bobbin provided for said bobbin support member.

2. The apparatus as defined in claim 1, wherein:

said roving bobbin is rotatably supported on said support element;

a thread guide arranged on said bobbin support member; and said roving bobbin being capable of supplying the roving thereof by means of said thread guide to a spinning unit of the spinning machine.

3. The apparatus as defined in claim 1, further including:

a pin member arranged so as to extend essentially vertically upwardly from said support element for mounting said roving bobbin; and the roving of said roving bobbin being taken-off from the roving bobbin overhead and being capable of being supplied to a spinning unit of said spinning machine.

4. The apparatus as defined in claim 1, wherein:

said bobbin support member comprises a vertically arranged rod;

a hook defining said means for detachably mounting said bobbin support member on said can provided at an upper end of said vertically arranged rod;

said hook being capable of being secured to an upper rim of the related can where said bobbin support member is detachably mounted;

said vertically arranged rod being provided with a handle;

said vertically arranged rod having a lower end;

a can contacting member provided at said lower end of said vertically arranged rod and which is capable of being brought into contact with the can.

5. The apparatus as defined in claim 4, wherein:

said bobbin support member comprises a substantially horizontally arranged rod mounted upon said vertically arranged rod:

said horizontally arranged rod having rod portions extending laterally to both sides of said vertically arranged rod; and a respective one of said support elements mounted at each of said laterally extending portion of said horizontally arranged rod.

6. The apparatus as defined in claim 5, wherein:

said bobbin support member is used with a can having a substantially circular-cylindrical side wall;

said horizontally arranged rod having a curvature essentially corresponding to the radius of curvature of the side wall of the said can and being contactingly supported on said can throughout substantially the entire length of said horizontally arranged rod.

* * * * *